United States Patent [19]

Gardner

[11] 4,213,444

[45] Jul. 22, 1980

[54] FIREPLACE HEATER UNIT

[76] Inventor: James J. Gardner, 210 Sherman Ave., Lancaster, Ohio 43130

[21] Appl. No.: 895,233

[22] Filed: Apr. 10, 1978

[51] Int. Cl.[2] ..... F24B 13/02

[52] U.S. Cl. ..... 126/130; 236/38

[58] Field of Search ..... 60/643, 645, 669, 670, 60/721, 648; 126/130, 132; 236/38; 237/9 R, 67

[56] References Cited

U.S. PATENT DOCUMENTS

| | | | |
|---|---|---|---|
| 161,423 | 3/1875 | Mathewson | 60/669 |
| 445,396 | 1/1891 | Edgerton | 237/67 |
| 4,131,231 | 12/1978 | Cleer, Jr. | 126/132 X |

FOREIGN PATENT DOCUMENTS

| | | | |
|---|---|---|---|
| 98047 | 3/1921 | France | 126/130 |

*Primary Examiner*—Allen M. Ostrager
*Assistant Examiner*—Stephen F. Husar

[57] ABSTRACT

The "Fireplace Heater Unit" conveys fireplace heat to the atmosphere through the means of hot water and steam. Steam pressure build-up is controlled by a regulator that releases steam through a nozzle at the proper pressure. This controlled steam is put to work turning a simple turbine which transmits to a fan (blower) and a pulley.

4 Claims, 4 Drawing Figures

FIREPLACE HEATER UNIT

SUMMARY

The "Fireplace Heater Unit" is made up of pipes and pipe fittings that are filled with water and inclosed at both ends by a sheet metal shroud or heater box. The shrouds have cold air intake openings at the bottom and discharge openings near the top. Hot water cross-connect piping gathers heat from the fireplace and transfers it to the air inside the shrouds. The hot air is then discharged into the atmosphere by fans. Piping above the water level is designated as steam piping. The steam build up is controlled by a pressure regulator that releases steam to a simple turbine. The turning action of the turbine is transmitted through a shaft to the fans. These fans discharge the hot air gathered by the shroud. Used steam is exhausted up the chimney or vent as a feeder tank replenishes the water level of the system. A safety valve is installed on the steam crossconnect piping for safe household use. Also, a removable pulley is attached to the shaft for the purpose of driving other equipment.

DESCRIPTION OF DRAWINGS

Two sheets of drawings are enclosed.

Sheet one is composed of FIG. 1 which is an arrangement view showing basic features of the invention. This is the only view showing the feeder tank. Sheet 2 is made up of FIGS. 2, 3 and 4.

DETAILED DESCRIPTION

Figure 1:
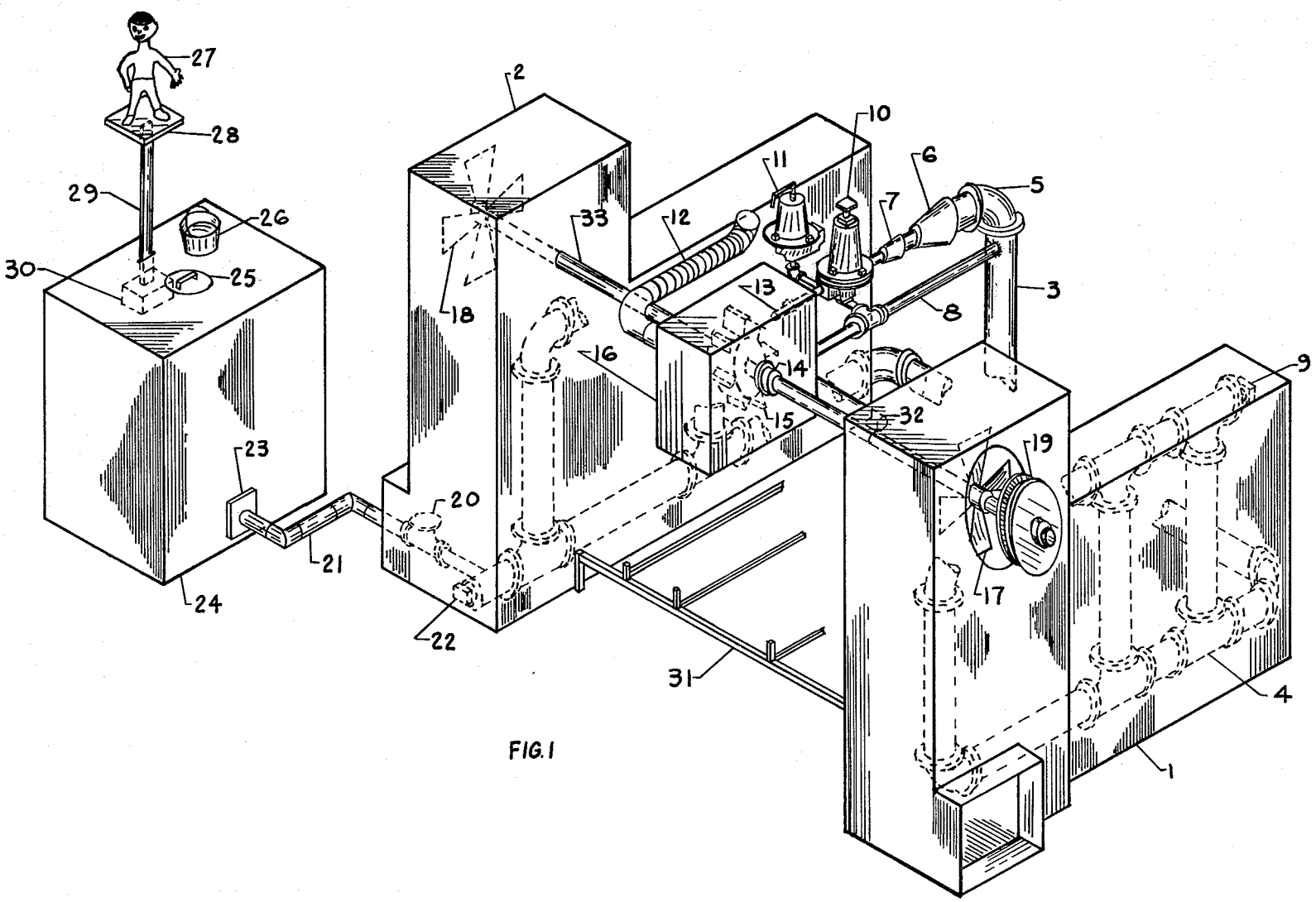
Figure 3:
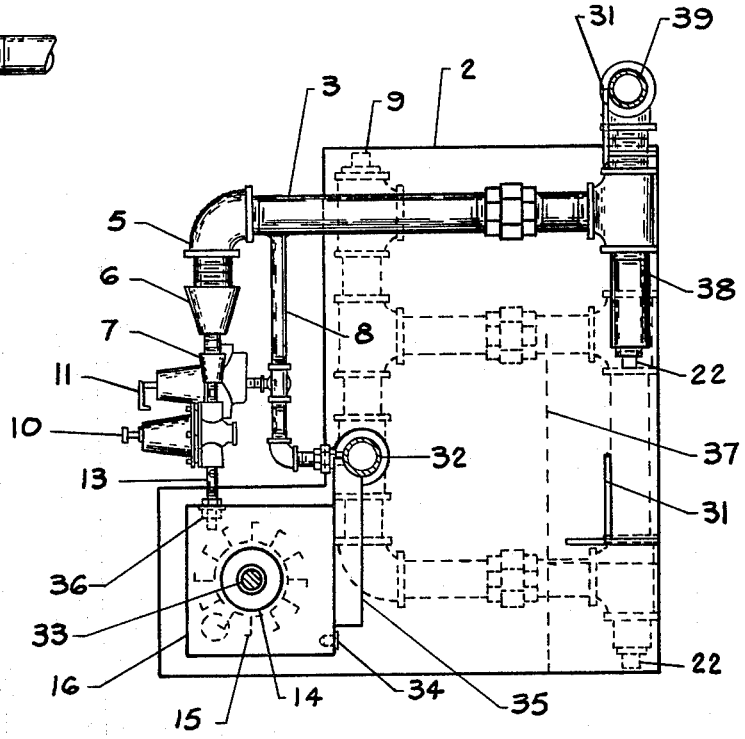
FIG. 3 is an elevation view taken at section 3—3 (from FIG. 2).

Numerals 1 and 2 of FIG. 1 are the sheet metal shrouds. There are square intake openings at the bottom for cold air entrance into the system. Numeral 37 of FIG. 3 shows a sheet metal closure used to route cold air to the rear of the shroud. The shrouds have circular cutouts near the top which act as hot air discharge openings. A clearance hole is put in each shroud for the shaft (#33) and piping (numbers 32 and 39). The piping (numbers 3,8, 13,32,38,39) is composed of standard threaded pipe joined together with 90 degree elbows (#5), tees(#4), valves (10 & 11), unions (40), and reducers (6 & 7), using appropriate pipe compound. Numerals 9 and 22 are threaded pipe plugs shown throughout the system. The system is filled with water to a level below the centerline of number 32. Filling is accomplished by removing cap (25) of FIG. 1 and filling tank (24) to within one inch of the top. The tank is joined to the system by tubing (21 of FIG. 1). This tubing is connected to the tank by number 23, a threaded connector. A threaded check valve (20) is installed to prevent flow of hot water into the tank (24). The tank is equipped with a float (30), a stem (29), a platform (28), and a figurine (27). As the water level in the tank arrive at a place in need of refilling, the man's hand will rest on the water bucket handle (26).

Figure 2:
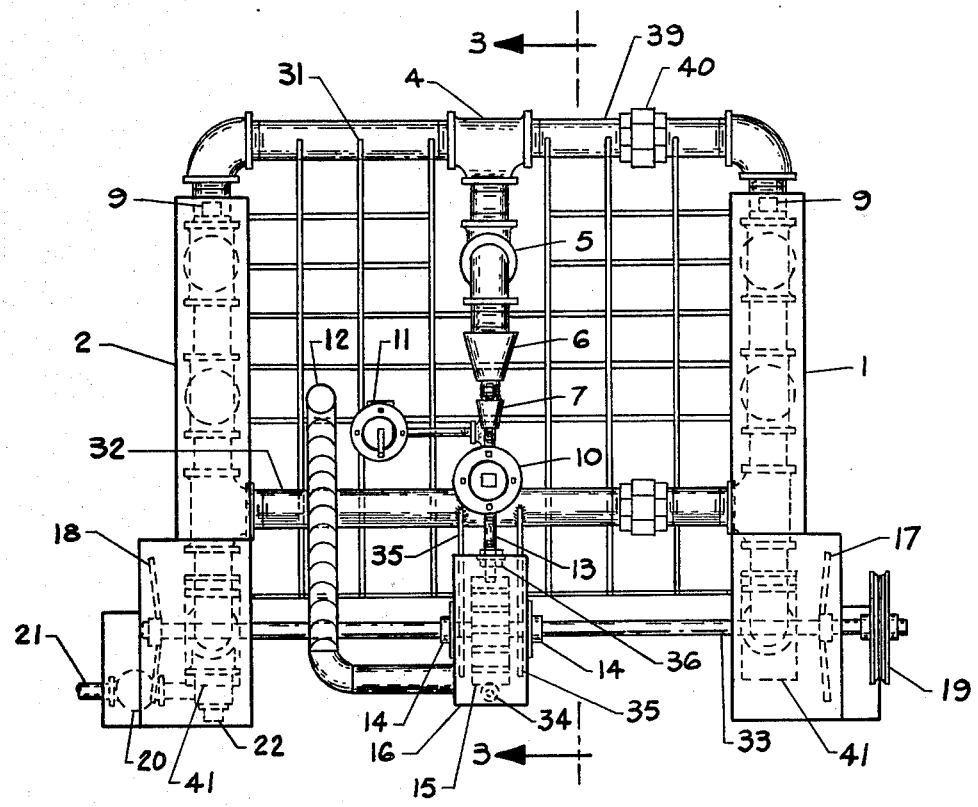
FIG. 2 is a plan view of the invention excluding the feeder tank.

Numeral 39 of FIG. 2 shows the hot water cross-connect pipe. Branching from this is numeral 38 of FIG. 3, which is plugged with number 22. Numeral 38 helps support the grate (31) and also absorbs much heat as it is directly under the fire. The rear of the grate rests on the hot water cross-connect pipe (39). The grate is to be removable for easy access to cleaning area. Numeral 3 is the main steam supplier. Hot water is turned to steam, which moves up and through the reducers (6&7) to the pressure regulator (10).

The pressure regulator is set to release steam at approximately 25 PSI. When this pressure is reached, steam is released to nozzle (13) and enters a sheet metal turbine box (16). The nozzle is secured and sealed to the turbine box (16) by number 36, a threaded connector. Now the steam strikes the sheet metal blades of the turbine (15) and starts the shaft (33) rotating. (The turbine body is welded to the shaft) Two seals, shown as number 14, prevent steamescape from the turbine box. These seals are attached to the shaft by set screws. Used steam is exhausted up the chimney or vent through number 12, which is made partly flexible for adjustment. At the bottom of the turbine box is a drain screw (number 34 FIG. 3) which should be removed occasionally to drain any condensation. The turbinebox (16) is supported by two steel bars (Num. 35 FIG. 3) that are welded to a crossconnect pipe (32). The turbine box is tack welded to the supports (35).

Figure 4:
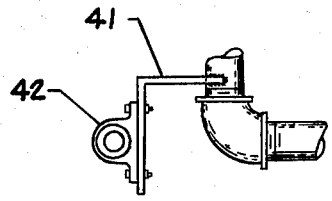
FIG. 4 is a detail pulled out to show the shaft supports and pillow block.

The shaft (33) is supported by two steel angle (41) as shown in FIG. 4. The angle (41) are welded to the piping at locations shown in FIG. 2. A pillow block (number 42 FIG. 4) is bolted to the support angle. Shaft #33 is inserted in the pillow block and secured to the bearing with a set screw. A flat milled on shaft (33) provides good seating for the set screws. Two fans (17 & 18) are installed on each side of the shaft near the discharge openings and are fastened to the shaft with set screws. (A flat is milled on shaft 33 for good seating of set screws.) Each fan (17&18) is designed to blow air out the discharge opening. A removable pulley (19) is attached to shaft (33) on one side only with set screws. (A flat milled surface seats the set screws.) The pulley (19) is to be attached to the shaft only when it is in use. Said pulley (19) is to be used with a belt to drive other equipment as needed.

Numeral 8 FIG. 3 shows the steam cross-connect pipe, which has one end welded to num. 3 as shown. This steam cross-connect pipe provides an outlet for steam build up in the piping inclosed by the shrouds (1&2). Connected to this cross-connect pipe (8) is a safety valve (11) which is set at approximately 40 PSI. It is held vertically and is directed away from the user.

What I claim is:

1. A "Fireplace Heater Unit" consisting of the combination of water conducting pipes located at the right and left hand side of the said heater unit, said pipes consisting of a lower horizontal run and an upper horizontal run said lower and upper horizontal runs being connected with a plurality of vertical pipes providing flow communication therebetween, said horizontal and vertical pipes being cross-connected at the lower rear of the said unit by a horizontal pipe run providing water flow communication between the said left and right hand side of said unit, a vertical pipe in communication with said horizontal cross-connect pipe at the rear of said unit whereby steam generation may be transferred to a pressure regulator, an upper horizontal cross-connect pipe run providing steam flow communication between said right and left hand side of said unit, a horizontal cross-connect pipe run with a safety valve disposed therein providing steam flow communication between said upper horizontal steam cross-connect pipe and said vertical steam generation pipe whereby said safety valve is in communication with all pressure points of said unit, shrouds or heater boxes enclosing said vertical and horizontal pipe runs located at the right and left hand side of the said unit, said shrouds or heater boxes having an opening at the lower portion thereof for cold air entry and an opening near the upper portion thereof for hot air discharge, said heater boxes having a closure whereby cold air must circulate there through and a removable grate providing means on which suitable fireplace fuel may be burned.

2. A "Fireplace Heater Unit" as recited in claim 1 wherein said pressure regulator discharges steam generation build up at a suitable pressure through a nozzle, said nozzle being in communication with a turbine box and affixed thereto with suitable seals, said turbine box being supported from said upper horizontal cross-connect pipe with suitable supports, said turbine box consisting of a drain plug and a flexible steam exhaust pipe, said turbine box provides means whereby a turbine may be completely enclosed, said turbine consisting of a plurality of blades extending from a wheel whereby said steam pressure may be directly converted to torque, said turbine being mounted on a shaft whereby said torque may be transmitted to right and left hand fans located within said right and left hand heater boxes, said shaft consisting of suitable seals connected thereunto at said turbine box, said shaft being suitably mounted in a pillow block at said right and left hand sides of said unit, said fans being suitably mounted on said shaft whereby hot air may be blown through said right and left hand hot air discharge openings.

3. A "Fireplace Heater Unit" as recited in claim 2 wherein said shaft further comprises a removable pulley, said pulley being located on one extreme end of said shaft whereby a belt may be conveniently installed thereon, said pulley being suitably attached on to said shaft whereon said pulley may be conveniently removed and replaced.

4. A "Fireplace Heater Unit" as recited in claim 1 wherein said water conducting pipes are in flow communication with a water feeder tank, water flow being toward the said fireplace heater unit only, this being provided by a check valve disposed in a horizontal tubing run from said feeder tank to said heater unit, said feeder tank being a convenient distance from said heater unit and generally away from the main heat, said feeder tank consisting of a removable cap, a float, a stem, a platform, a figurine, and a minature water bucket, said feeder tank to indicate need of refilling when said figurine's hand rests on said water bucket's handle.

* * * * *